United States Patent [19]

Fontanille

[11] Patent Number: 5,029,293

[45] Date of Patent: Jul. 2, 1991

[54] DEVICE FOR LOCATING AN INDIVIDUAL FALLEN INTO THE SEA

[76] Inventor: Pierre Fontanille, 2, Place de la Coulomine, Villeneuve de la Raho, France

[21] Appl. No.: 472,161

[22] Filed: Jan. 30, 1990

[51] Int. Cl.[5] ..... G08B 21/00

[52] U.S. Cl. ..... 340/573; 340/604; 441/89

[58] Field of Search ..... 340/573, 604; 441/89, 441/136; 116/26, 211, 202

[56] References Cited

U.S. PATENT DOCUMENTS

| | | | |
|---|---|---|---|
| 2,418,392 | 4/1947 | Bender | 116/211 |
| 3,106,184 | 10/1963 | Shea | 441/89 |
| 3,122,736 | 2/1964 | Weber | 340/604 |
| 3,621,501 | 11/1971 | Jordan | 441/89 |
| 4,464,129 | 8/1984 | Vancheri et al. | 116/26 |
| 4,527,504 | 7/1985 | Byerley | 116/211 |
| 4,714,914 | 12/1987 | Boe | 340/573 |

*Primary Examiner*—Glen R. Swann, III

*Attorney, Agent, or Firm*—Fleit, Jacobson, Cohn, Price, Holman & Stern

[57] ABSTRACT

A safety device for locating an individual fallen into the sea includes a visual indicator in the form of a dye and an intermittently operated lamp (3), and a radio transmitter (9) for transmitting a radio signal. The dye is contained in a vessel (4) having a trap door and control circuits (12) are provided having a power source (5) and automatically operated by a water sensitive microswitch (10) to open the trap door of the dye vessel (9), energize the intermittent lamp (3) and energize the radio transmitter (9), all of the components being integral with a helmet (1) worn by the individual. A radio receiver may also be provided on a boat for receiving signals transmitted from the radio device and guiding the boat to the radio device.

20 Claims, 1 Drawing Sheet

DEVICE FOR LOCATING AN INDIVIDUAL FALLEN INTO THE SEA

BACKGROUND OF THE INVENTION

1. Field of the Invention

This invention relates to a device for locating individuals fallen into the sea from a boat, including visual and radio locating means.

2. Description of the Prior Art

Previously known devices for locating persons adrift in the sea are of types disclosed in the following patents:

British Pat. GB 2,082,126 (SUBMEX) discloses a survival floating device including means to detect the device and a housing with means for survival and that simulates the features of a human body floating on the water, the spotting means including an intermittent lamp and a transmitting radio;

U.S. Pat. No. 2,716,961 (MANHEIM) discloses a device to color the water, so as to enable an air rescue of a person shipwrecked, the device being made by impregnating by dying a floatable resin foam;

French Pat. No. FR 2,066,624 (DROGO) discloses a device to release, from a power supply and electrical contact means, buoys to detect shipwrecked persons including a radio transmitting device and eventually a telescopic antenna extendable by a powder cartridge;

British Pat. No. GB 1,179,521 (GALLOWAY) describes a buoy type rescue device that can indicate its position by means of an external visualization lamp, either permanently or intermittently engaged by a built-in battery;

U.S. Pat. No. 2,750,027 (CUMMINGS) discloses a device for producing a visual indication by producing a colored sheet on the sea from a block of dying material that includes a means for preventing mud from clogging in order to obtain a continuous sheet.

These prior art devices all have means that include either visual devices, or radio devices, or both, or dying devices, always located either on buoys, or on independent floats of the shipwreck, but none includes all of these means on the same support.

BRIEF SUMMARY OF THE INVENTION

In order to improve the benefits and effectiveness of the above mentioned devices this invention provides the user with a helmet which at the same time offers a protective function, and comprises a complete set of locating means.

Some of such locating means may be neutralized when not required (day or night).

BRIEF DESCRIPTION OF THE DRAWINGS

The invention will now be described in detail with reference to the accompanying drawings wherein.

DESCRIPTION OF THE PREFERRED EMBODIMENT

Figure 1:
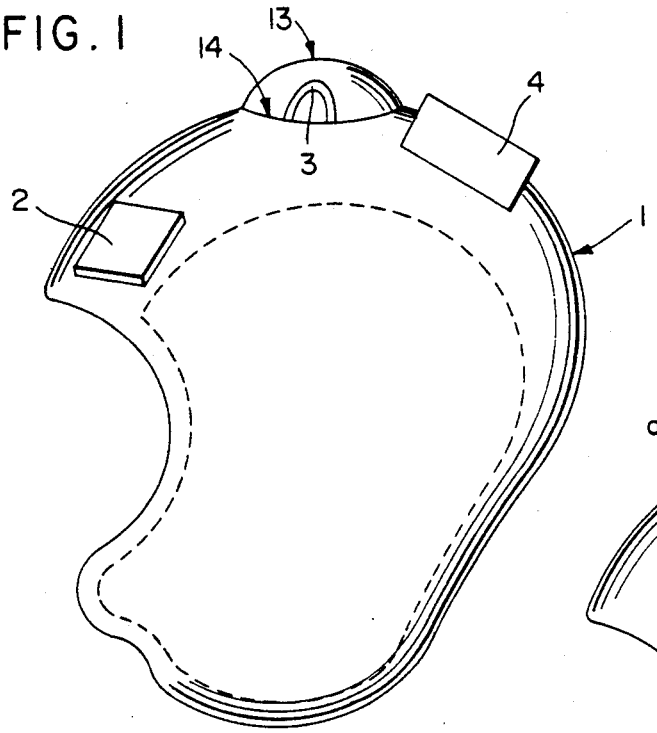
FIG. 1 is an elevational view of the helmet of the invention showing the location of places thereon of the different subassemblies integral with the device.
Figure 3:
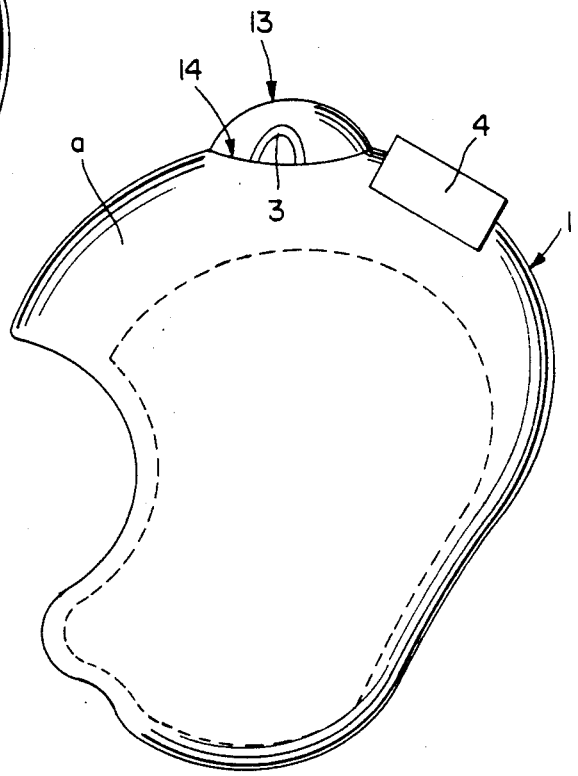
FIG. 3 is a view similar to FIG. 1 showing a different embodiment of the invention.
Figure 2:
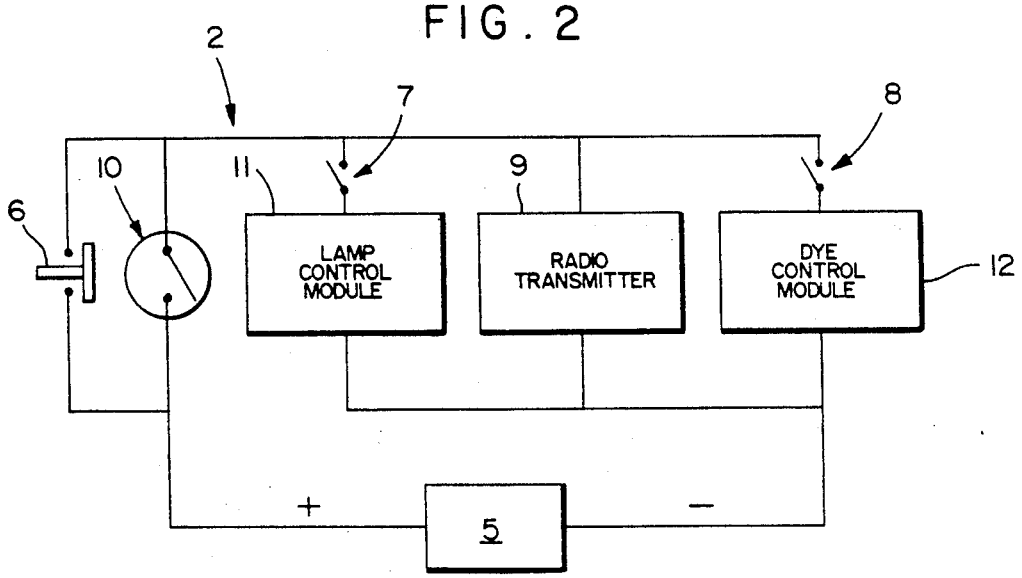
FIG. 2 is a circuit diagram of the power and control device.

The device shown in the figures comprises a helmet 1 to be worn by a shipwrecked person or anyone adrift at sea, having power and control circuits located in a removable front casing 2 built into the helmet; these circuits can be located, in a variant of the invention shown in FIG. 3, at the inner top of the helmet in area (a). The removable front casing containing the power and control assembly can be removed for recharging the battery and may also contain switches to selectively disable the functions of the device. The power and control circuits (FIG. 2) include a water-sensitive micro-contact 10, automatically actuating all the control modules when contacted by water, a manual switch 6 for compensating for any failure of the micro-contact, switches 7 and 8 individually inhibiting, when open, the control modules of the visual location means, a rechargeable battery 5, the transmitting radio 9 for continuously sending signals on a certain frequency compatible with the allowed sea frequencies, the control module 11 for the intermittent signal of a xenon flash lamp 3, and control module 12 for the dye trap-door on vessel 4.

The flash lamp 3 is located on the top of the helmet in a housing closed by a transparent cap 13 and includes at its bottom a reflecting part 14.

The dye product used is also fluorescent and dissuading to aquatic assailants such as sharks. It is located in a vessel 4 that includes a trap-door operated by the control circuits allowing it to enter the ambient water.

The helmet is made, for example, of methacrylate and its total weight is about 600 grams while an authorized motorcar helmet weighs over 1 Kg. A radio receiver, centered on the frequency of the transmitter, can be placed in the boat to remotely control its functions (motor, rudder, sail unfurling) allowing it to be operated back to the transmitting point.

I claim:

1. Safety signalling device for locating an individual fallen into the sea, comprising:

visual means comprising an intermittently operated lamp means and a liquid dye means contained in a vessel;

radio means for transmitting a radio signal;

power and control circuits for operating said visual means and radio means; and a helmet to be worn by said individual, said visual and radio means and said power and control circuits being integral with said helmet.

2. Device as claimed in claim 1 and further comprising:

a boat from which said individual has fallen;

a radio receiving means located in the boat for receiving signals from said radio means for driving the boat by motor, rudder and sail unfurling functions to said radio means.

3. Device as claimed in claim 1 wherein:

said power and control circuits are located in a removable casing at the front of said helmet.

4. Device, as claimed in claim 3, wherein:

said power circuits are of the rechargeable battery type.

5. Device, as claimed in claim 4, wherein:

said control circuits further comprise water-sensitive micro-contact means for automatically actuating said control circuits when contacted by water.

6. Device, as claimed in claim 5, wherein:

said control circuits include manually operated switch means in parallel with said micro-contact means for selectively by-passing said micro-contact upon failure thereof.

7. Device, as claimed in claim 6, wherein:

said control circuits include switch means for selectively individually preventing operation of said visual means.

8. Device, as claimed in claim 7, wherein said visual means comprises:

intermittently operated flash lamp means located at the top of the helmet;

a transparent cap closing said housing;

said dye means being a coloring and fluorescent product highly visible and dissuading to aquatic creatures; and a trap-door on said vessel operated by said control circuits to open for allowing said dye to enter and color ambient water to provide a signal.

9. Device, as claimed in claim 3, wherein:

said control circuits further comprise water-sensitive micro-contact means for automatically actuating said control circuits when contacted by water.

10. Device, as claimed in claim 9, wherein:

said control circuits include manually operated switch means in parallel with said micro-contact means for selectively by-passing said micro-contact upon failure thereof.

11. Device, as claimed in claim 3, wherein:

said control circuits include switch means for selectively individually preventing operation of said visual means.

12. Device, as claimed in claim 3, wherein said visual means comprises:

intermittently operated flash lamp means located at the top of the helmet;

a transparent cap closing said housing;

said dye means being a coloring and fluorescent product highly visible and dissuading to aquatic creatures; and a trap-door on said vessel operated by said control circuits to open for allowing said dye to enter and color ambient water to provide a signal.

13. Device as claimed in claim 1, wherein:

said power and control circuits are located at the inner top of said helmet.

14. Device, as claimed in claim 13, wherein:

said power circuits are of the rechargeable battery type.

15. Device, as claimed in claim 13, wherein:

said control circuits further comprise water-sensitive micro-contact means for automatically actuating said control circuits when contacted by water.

16. Device, as claimed in claim 1, wherein:

said power circuits are of the rechargeable battery type.

17. Device, as claimed in claim 1, wherein:

said control circuits further comprise water-sensitive micro-contact means for automatically actuating said control circuits when contacted by water.

18. Device, as claimed in claim 17, wherein:

said control circuits include manually operated switch means in parallel with said micro-contact means for selectively by-passing said micro-contact means upon failure thereof.

19. Device, as claimed in claim 1, wherein:

said control circuits include switch means for selectively individually preventing operation of said visual means.

20. Device, as claimed in claim 1, wherein: said visual means comprises:

intermittently operated flash lamp means located in a housing at the top of the helmet;

a transparent cap closing said housing;

said dye means being a coloring and fluorescent product highly visible and dissuading to aquatic creatures; and a trap-door on said vessel operated by said control circuits to open for allowing said dye to enter and color ambient water to provide a signal.

* * * * *